US007244094B2

(12) United States Patent
Miura et al.

(10) Patent No.: US 7,244,094 B2
(45) **Date of Patent: *Jul. 17, 2007**

(54) LOW NOISE IMPELLER PUMPS

(75) Inventors: Satoshi Miura, Aichi-ken (JP); Masaki Ikeya, Aichi-ken (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 218 days.

This patent is subject to a terminal disclaimer.

(21) Appl. No.: 10/628,330

(22) Filed: Jul. 29, 2003

(65) Prior Publication Data

US 2004/0022652 A1 Feb. 5, 2004

(30) Foreign Application Priority Data

Aug. 2, 2002 (JP) ..... 2002-226308

(51) Int. Cl.
*F04D 5/00* (2006.01)

(52) U.S. Cl. ..... 415/55.4; 415/55.1; 415/106; 415/119; 416/181

(58) Field of Classification Search ..... 415/55.1, 415/55.2, 55.3, 55.4, 55.5, 55.6, 55.7, 106, 415/119; 416/181
See application file for complete search history.

(56) References Cited

U.S. PATENT DOCUMENTS 4,915,582 A * 4/1990 Nishikawa ..... 415/55.1
6,224,323 B1 * 5/2001 Murase et al. ..... 415/55.1
6,336,788 B1 * 1/2002 Fujii et al. ..... 415/55.1
6,443,692 B1 * 9/2002 Sakamoto et al. ..... 415/55.1
6,527,507 B2 * 3/2003 Rollwage et al. ..... 415/55.1
6,659,713 B1 * 12/2003 Fujii et al. ..... 415/55.1
6,733,230 B2 * 5/2004 Miura et al. ..... 415/55.1

FOREIGN PATENT DOCUMENTS

| | | |
|---|---|---|
| EP | 0 909 897 | 4/1999 |
| JP | 03 18688 | 1/1991 |
| JP | 08 14814 | 1/1996 |
| JP | 2000 329085 | 1/2002 |

* cited by examiner

*Primary Examiner*—Christopher Verdier
(74) *Attorney, Agent, or Firm*—Dennison, Schultz & MacDonald

(57) ABSTRACT

An impeller pump for a fluid includes a rotary impeller (10; 20) and a pump casing (4). The pump casing defines a first pump channel (51) and a second pump channel (71). The impeller is disposed within the pump casing and opposes to the first pump channel and the second pump channel, respectively. The fluid discharged from the first pump channel and the fluid discharged from the second pump channel converge at a convergence channel (62). A pulsation canceling device serves to cancel pulsations of the fluid discharged from the first pump channel and the second pump channel, respectively. An impact reducing device (155, 175; 357; 455, 457; 555, 557) serves to reduce impacts produced by at least one of the flow of the fluid from the first pump channel and the flow of the fluid from the second channel.

18 Claims, 11 Drawing Sheets

LOW NOISE IMPELLER PUMPS

This application claims priorities to Japanese patent application serial number 2002-226308, the contents of which are incorporated herein by reference.

BACKGROUND OF THE INVENTION

1. Field of the Invention

The present invention relates to impeller pumps of a type known as Westco pumps, generative or friction pumps, cascade pumps and circumferential-flow pumps that have rotary impellers.

2. Description of the Related Art

A known Westco pump is shown in FIGS. 23 and 24, in which the Westco pump includes a single impeller 110 disposed rotatably within a pump casing 104. The impeller 110 has a substantially circular disk-like configuration and rotates as a shaft 109*a* of an armature of a motor section (not shown) rotates. A predetermined number of grooves 112 are formed in each of upper and lower surfaces of the impeller 110 and are arranged at a predetermined pitch in the circumferential direction. The grooves 112 formed in the lower surface and the grooves 112 formed in the upper surface are arranged symmetrically with each other. Thus, the grooves 112 formed in the lower surface and the grooves 112 formed in the upper surface are arranged at the same circumferential positions with each other.

Referring to FIG. 23, the pump casing 104 defines pump channels 151 and 171 that oppose to the grooves 112 formed in the upper surface and the grooves 112 formed in the lower surface of the impeller 110, respectively. Suction ports 152 and 172 are defined in communication with start ends of the pump channels 151 and 171, respectively. Discharge ports 153 and 173 are defined in communication with terminal ends of the pump channels 151 and 171, respectively. As shown in FIG. 24, the suction port 152 and the discharge port 153 of the pump channel 151 are separated from each other by a partition wall 105*a* that defines an interruption region. Similarly, the suction port 172 and the discharge port 173 of the pump channel 171 are separated from each other by a partition wall 107*a*. A fuel suction channel 170 is defined in the pump casing 104 and is open into a suction side region. The fuel suction channel 170 communicates with the suction ports 152 and 172. A fuel discharge channel 150 is defined in the pump casing 104 and is open into a discharge side region. The fuel discharge channel 150 communicates with the discharge ports 153 and 173. Incidentally, as shown in FIG. 24, the discharge ports 153 and 173 are disposed at the same position with each other in the circumferential direction of the impeller 110.

Referring to FIG. 23, in order to perform a pumping operation, the impeller 110 is rotated, so that a fuel is drawn from the suction side through the fuel suction channel 170. Subsequently, the fuel is diverged into the inlet ports 152 and 172 and then enters the pump channels 151 and 171. The fuel that has entered the pump channels 151 and 171 receives kinetic energies from the grooves 112 (i.e., fins defined by the grooves 112) of the impeller 110 and is pressurized to be fed through the pump channels 151 and 171. The fuel that has been fed to the terminal end of the pump channel 151 and the fuel that has been fed to the terminal end of the pump channel 171 are converged after passing through the discharge ports 153 and 173, respectively. The fuel is then discharged via the fuel discharge channel 150.

However, in the known Westco pump, the grooves 112 formed in the lower surface and the grooves 112 formed in the upper surface are arranged at the same positions in the circumferential direction of the impeller 110. In addition, the discharge port 153 of the pump channel 151 and the discharge port 173 of the pump channel 171 are disposed at the same position in the circumferential position of the impeller 110. Therefore, the phase of pulsation of the fuel discharged from the pump channel 151 and the phase of pulsation of the fuel discharged from the pump channel 171 are the same with each other, and the pulsations of fuel may be intensified by the convergence of the fuel discharged from the discharge ports 153 and 173. As a result, pump noises that may be caused by the pulsations may increase. Here, the term "pulsation" is used to mean a periodic change in pressure of the fuel during the operation of the pump.

Furthermore, in the known Westco pump, the directions of flow of the fuel from the pump channels 151 and 171 are changed at substantially right angles toward the discharge ports 153 and 173, respectively. Therefore, the fuel collides with corner portions 151*a* and 171*a* (see FIG. 24) at the terminal ends of the pump channels 151 and 171. Pump noises also may be increased due to impacts caused by this collision. Therefore, it has been desired to reduce pump noises that may be caused by the pulsations and the impacts of the fluid.

Japanese Laid-Open Patent Publication Nos. 3-18688, 8-14814 and 2000-329085 teach Westco pumps having impact reduction means. However, these publications relate to Westco pumps in which a fluid is drawn from a suction port disposed on one side of an impeller and is then discharged from a discharge port disposed on the other side of the impeller. The impeller has a plurality of grooves that are formed in each of upper and lower surfaces of the impeller and are spaced from each other in the circumferential direction by a predetermined pitch. The impact reduction means is provided for reducing impacts of the fluid, which impacts may be produced when the direction of the flow of the fluid is changed toward the discharge port. Thus, the Westco pumps of the publications are not configured to discharge the fluid from two discharge ports that are disposed on both upper and lower sides of the impeller. Therefore, the publications do not teach reduction means that is designed or intended to reduce the pulsations of the fluid that may be intensified due to the convergence of the fluid discharged from the discharge ports.

SUMMARY OF THE INVENTION

It is accordingly an object of the present invention to teach improved techniques for reducing or minimizing noises of impeller pumps, which noises may be produced by pulsations and impacts of fluid.

According to one aspect of the present teachings, impeller pumps for fluids are taught that may include a rotary impeller and a pump casing. The pump casing may define a first pump channel and a second pump channel. The impeller may be disposed within the pump casing and may oppose to the first pump channel and the second pump channel, respectively. Therefore, the fluid may receive pumping actions by the impeller at both the first and the second pump channels as the impeller rotates. The fluid discharged from the first and second pump channel and the fluid discharge from the second pump channel may then be converged. The fluid discharged from the first pump channel and the second pump channel may have pulsations, e.g., due to grooves of the impeller defined for causing pumping actions. A pulsation canceling device may cancel the pulsations of the fluid discharged from the first and second pump channels. In addition, an impact reducing device may reduce impacts produced by the flow of the fluid from the first pump channel and/or the flow of the fluid from the second pump channel. For example, such impacts may be produced when the fluid collides with an end wall, e.g., a partition wall, that defines an end portion of the pump channel in the rotational direction.

Because the pulsations may be canceled by the pulsation canceling device and the impacts may be reduced by the impact reducing device, noises that may be produced by the pulsations and the impacts may be reduced or minimized. In particular, because of the synergism action of the pulsation canceling device and the impact reducing device, the noises may be further reduced.

According to another aspect of the present teachings, the impact reducing device serves to shift a phase of the pulsation of the fluid discharged from the first discharge port from a phase of the pulsation of the flow of the fluid discharged from the second discharge port, so that the pulsations may cancel each other. In case that the cyclic period of the pulsation of the fluid discharge from the first discharge port is the same as the cyclic period of the pulsation of the fluid discharged from the second discharge port, the shift of phase may be set to be half the cyclic period of the pulsation.

More specifically, if the impeller has grooves formed on each side and spaced from each other by a predetermined pitch, the phase may be suitably shifted by (1) displacing the grooves on one side of the impeller from the grooves on the other side of the impeller by a distance of half the pitch of the grooves or (2) displacing a first suction port (that communicates with the first pump channel) from a second suction port (that communicates with the second pump channel) by a distance corresponding to half the pitch of the grooves.

According to another aspect of the present teachings, the impact reducing device may serve to gradually reduce a sectional area of a part, in particular a part opposing to the grooves of the impeller, of a terminal end of the first pump channel and/or the second pump channel. Preferably, the sectional area of the part of the terminal end may be reduced in the rotational direction of the impeller. With this arrangement, the direction of flow of the fluid may be gradually changed and high order frequency components of the pulsations may be reduced. As a result, noises may be reduced or minimized. The high order frequency (HOF) of the pulsation may be determined by the following expression:

$$HOF=K\cdot Z\cdot N(K\geqq 2)$$

Here, Z is the number of impellers and N is the rotational speed (rps) of the impeller(s). In this case, a basic frequency (BSF) of the pulsation may be expressed by "BSF=Z·N" and HOF components are those having frequencies greater than BSF.

For example, the sectional area of the part of the terminal end may be reduced by reducing a width in the radial direction of the impeller and/or a depth in the axial direction of the part.

According to another aspect of the present teachings, at least one communication hole may be formed in the impeller. The communication hole may communicate between a pair of the grooves that are defined in a first surface and a second surface of the impeller, respectively, and oppose to each other in an axial direction of the impeller. The grooves in the first surface of the impeller and the grooves in the second surface of the impeller may oppose to the first pump channel and the second pump channel, respectively. Therefore, the first pump channel and the second pump channel may communicate with each other through at least one communication hole. As a result, the pressure within the first pump channel and the pressure within the second pump channel may be equalized, so that the impeller can smoothly rotate. Therefore, the efficiency of the pump can be improved.

According to another aspect of the present teachings, the impeller pumps may further include a motor section that serves to rotate or drive the impeller. This arrangement is particularly advantageous when the impeller pumps are used as in-tank fuel pumps for pumping fuels stored in fuel tanks of automobiles.

BRIEF DESCRIPTION OF THE DRAWINGS

Additional objects, features and advantages of the present invention will be readily understood after reading the following detailed description together with the claims and the accompanying drawings, in which:

DETAILED DESCRIPTION OF THE INVENTION

Figure 1:
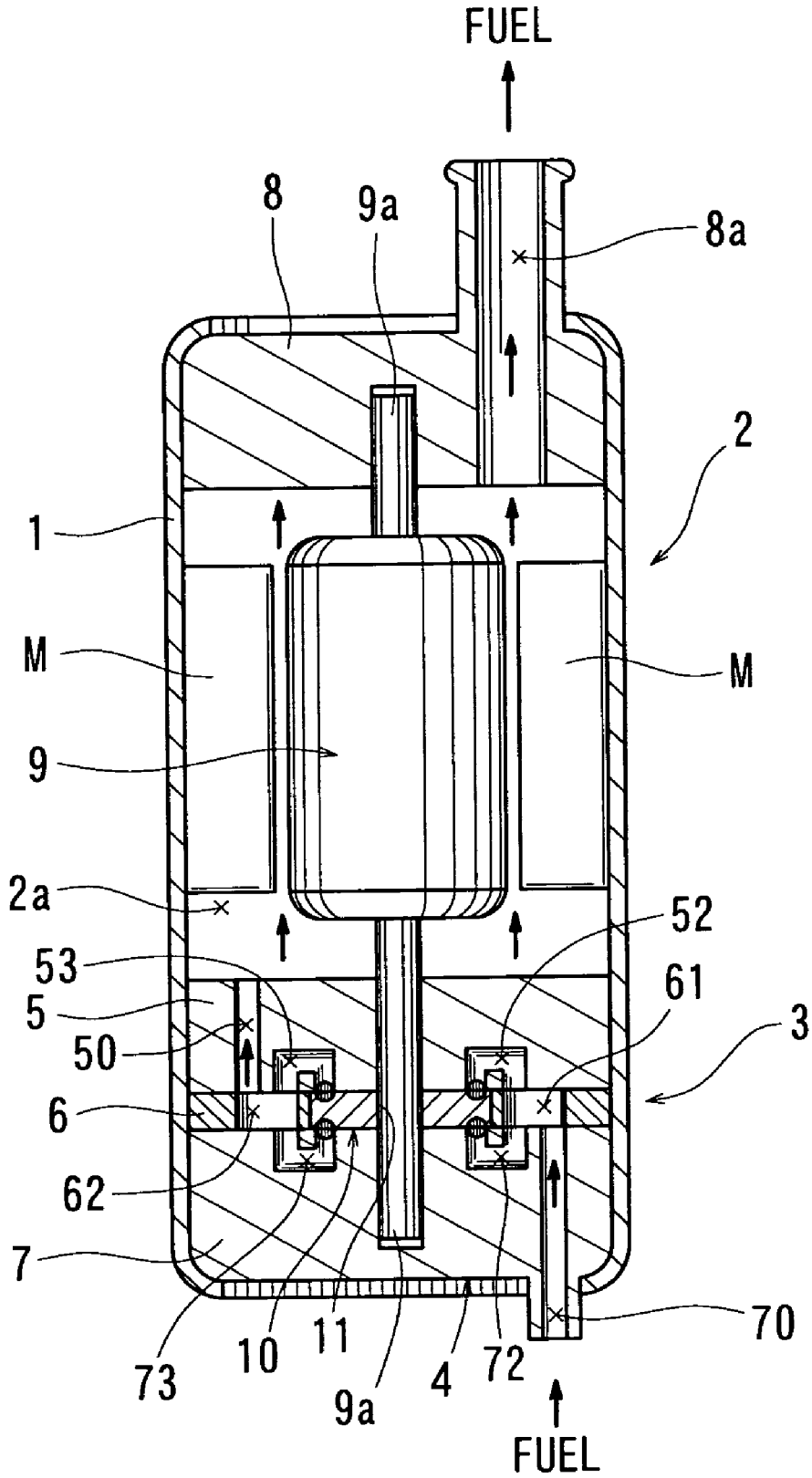
FIG. 1 is a vertical sectional view of a basic representative Westco pump according to the present invention.

In one embodiment of the present teachings, impeller pumps, e.g., Westco pumps, may include a rotary impeller. The impeller may have a first surface and a second surface opposing to each other. Each of the first and second surfaces may include a plurality of grooves arranged in a circumferential direction of the impeller and spaced from each other by a predetermined pitch. The impeller may be disposed within a pump casing that defines a first pump channel and a second pump channel.

The first pump channel and the second pump channel may oppose to the grooves formed in the first surface and the grooves formed in the second surface of the impeller, respectively. The first pump channel may communicate with a first suction port and a first discharge port that are separated from each other by a first partition wall. The second pump channel may communicate with a second suction port and a second discharge port that are separated from each other by a second partition wall.

The first and second discharge ports may communicate with a convergence channel, so that the fluid discharged from the fist discharge port and the fluid discharged from the second discharge port may converge at the convergence channel.

A pulsation canceling device may cancel pulsations of the fluid discharged from the first discharge port and the second discharge port, respectively.

An impact reducing device may reduce or minimize impacts of the fluid caused by change of direction of a flow of the fluid discharged from the first pump channel toward the first discharge port and/or a flow of the fluid discharged from the second pump channel toward the second discharge port.

Because the pulsations may be canceled by the pulsation canceling device and the impacts may be reduced by the impact reducing device, noises that may be produced by the pulsations and the impacts may be reduced or minimized. In particular, because of the synergism action of the pulsation canceling device and the impact reducing device, the noises may be further reduced.

According to another embodiment of the present teachings, the canceling device may shift a phase of the pulsation of the fluid discharged from the first discharge port from a phase of the pulsation of the flow of the fluid discharged from the second discharge port.

For example, in order to shift the phase, the grooves of the impeller defined in the first surface may be displaced from the grooves defined in the second surface by a predetermined distance, e.g., half the pitch of the grooves of the impeller. In such a case, the first discharge port and the second discharge port may be disposed at the same position in the circumferential direction of the impeller.

Alternatively, the first discharge port may be shifted from the second discharge port by a distance corresponding to half the pitch of the grooves of the impeller. In such a case, the grooves of the impeller defined in the first surface and the grooves of the impeller defined in the second surface may be disposed at the same positions in the circumferential direction of the impeller.

In another embodiment of the present teachings, the impact reducing device may serve to gradually reduce a sectional area of a part, in particular a part opposing the corresponding grooves of the impeller, of a terminal end of the first pump channel and/or the second pump channel. Preferably, the sectional area of the part of the terminal end may be reduced in the rotational direction of the impeller.

For example, the impact reducing device may include a width decreasing region defined by the terminal end of the first pump channel and/or the second pump channel, so that the width of the part opposing to the grooves may gradually decrease in the rotational direction of the impeller. The width decreasing region may extend along the rotational direction of the impeller or may extend in the direction outward from the first pump channel and/or the second pump channel in the radial direction.

Alternatively, the impact reducing device may include a depth decreasing region disposed at the terminal end of the first pump channels and/or the second pump channel, so that the depth of the part opposing to the grooves may gradually decrease in the rotational direction of the impeller.

Preferably, the depth decreasing region may include an inclined surface that is inclined in the rotational direction of the impeller.

In another embodiment of the present teachings, at least one communication hole may be defined in the impeller. The communication hole may serve to communicate between a pair of the grooves that are defined in the first surface and the second surface, respectively, and oppose to each other in an axial direction of the impeller. Therefore, the first pump channel and the second pump channel may communicate with each other via the communication hole. As a result, the pressure within the first pump channel and the pressure within the second pump channel may be equalized, so that the impeller can smoothly rotate. Therefore, the efficiency of the pump can be improved. Such a communication hole may be provided for all the opposing pairs of the grooves or may be formed for only a predetermined number of opposing pairs of the grooves.

Each of the additional features and teachings disclosed above and below may be utilized separately or in conjunction with other features and teachings to provide improved impeller pumps and using such impeller pumps. Representative examples of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Various representative impeller pumps will now be described with reference to FIGS. 1 to 22. The representative impeller pumps may be used as fuel pumps that are disposed within fuel tanks of vehicles, e.g., automobiles. For the illustration purpose, a basic structure of the representative impeller pumps will be described with reference to FIGS. 1 to 10 and thereafter the details of the representative impeller pumps will be described with reference to FIGS. 11 to 22.

Referring to FIG. 1, there is shown an impeller pump that includes a basic structure of the representative impeller pumps. The impeller pump shown in FIGS. 1 will be hereinafter called "basic representative impeller pump." The basic representative impeller pump may be configured as a Westco pump and may generally include a substantially cylindrical pump housing 1, a motor section 2 and a pump section 3. The pump section may be assembled within the pump housing 1 and may serve as a drive source. The pump section 3 may be driven by the motor section 2.

The motor section 2 may be configured as a brush-type DC motor. A pump casing 4 may be disposed at one end (lower end as viewed in FIG. 1) of the pump housing 1. A motor cover 8 may be disposed at the other end (upper end as viewed in FIG. 1) of the pump housing 1. A space 2*a* may be defined in the pump housing 1. Magnets M may be mounted to the inner circumferential wall of the pump casing 4 and may oppose to the space 2*a*. An armature 9 may be disposed within the space 2*a* and may have a shaft 9*a* that extends upward and downward from the armature 9. One end (lower end as viewed in FIG. 1) of the shaft 9*a* of the armature 9 may be rotatably supported by the pump casing 4. On the other hand, the other end (upper end as viewed in FIG. 1) of the shaft 9*a* may be rotatably supported by the motor cover 8. A fuel outlet 8*a* may be defined in the motor cover 8 for discharging the fuel from the space 2*a* to the outside of the pump. A fuel delivery pipe (not shown) may be connected to the fuel outlet 8*a* and may serve to deliver the fuel to an engine (not shown) of an automobile.

In order to rotate the armature 9, a DC electric power may be supplied from a DC power source (not shown) to the armature 9 (that may be an armature coil) via terminals (not shown) that are mounted on the motor cover 8. The other elements of the motor section 2 associated with the armature 9 are well known in the art, and therefore, an explanation of these elements will not be necessary. In addition, any other type of known motors may be incorporated as the motor section 2.

Figure 2:
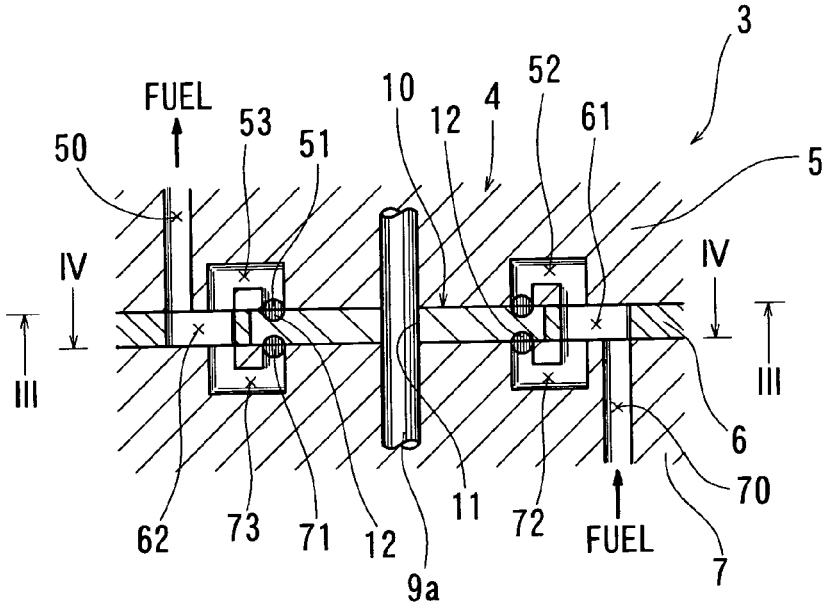
FIG. 2 is an enlarged sectional view of a pump section of the basic representative Westco pump.

The pump section 3 may be configured as a Westco pump and will now be described. Referring to FIG. 2, the pump section 3 may include the pump casing 4 and a single impeller 10 that is rotatably disposed within the pump casing 4. Preferably, the pump casing 4 may be constituted by an assembly of three casing elements, i.e., an upper pump cover 5, a spacer 6 and a pump body 7 that are disposed on the upper, middle and lower positions, respectively. The pump casing 4 may define an impeller accommodating space, so that an impeller 10 can rotate within the impeller accommodating space.

Figure 7:
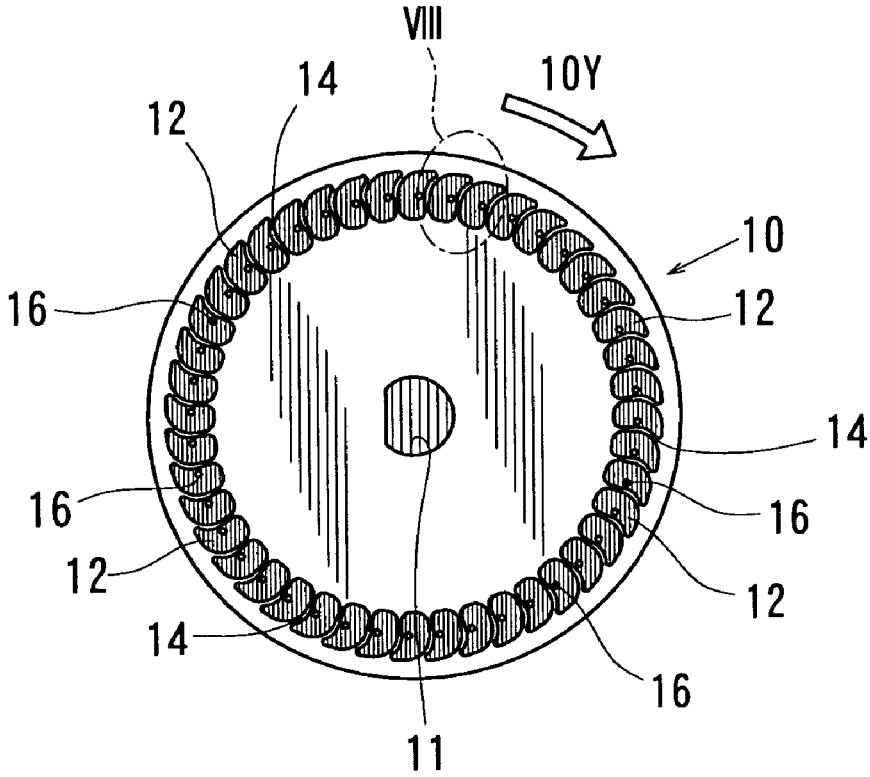
FIG. 7 is a view of a first impeller as viewed from a first direction.

Referring to FIG. 7, the impeller 10 may have a substantially disk-like configuration and may have a substantially D-shaped axial hole II formed in the center of the impeller 10. The axial hole 11 of the impeller 10 may engagingly receive one end of the shaft 9*a* that extends downward from the armature 9, so that the impeller 10 can rotate as the shaft 9*a* rotates.

A predetermined number of grooves 12 may be formed in the peripheral region of each of a first surface and a second surface opposing to the first surface of the impeller 10. The grooves 12 formed in each of the first and second surfaces are arranged to be spaced equally from each other in the circumferential direction of the impeller 10 by a predetermined pitch. A fin 14 may be defined as a partition between each two adjacent grooves 12.

Figure 9:
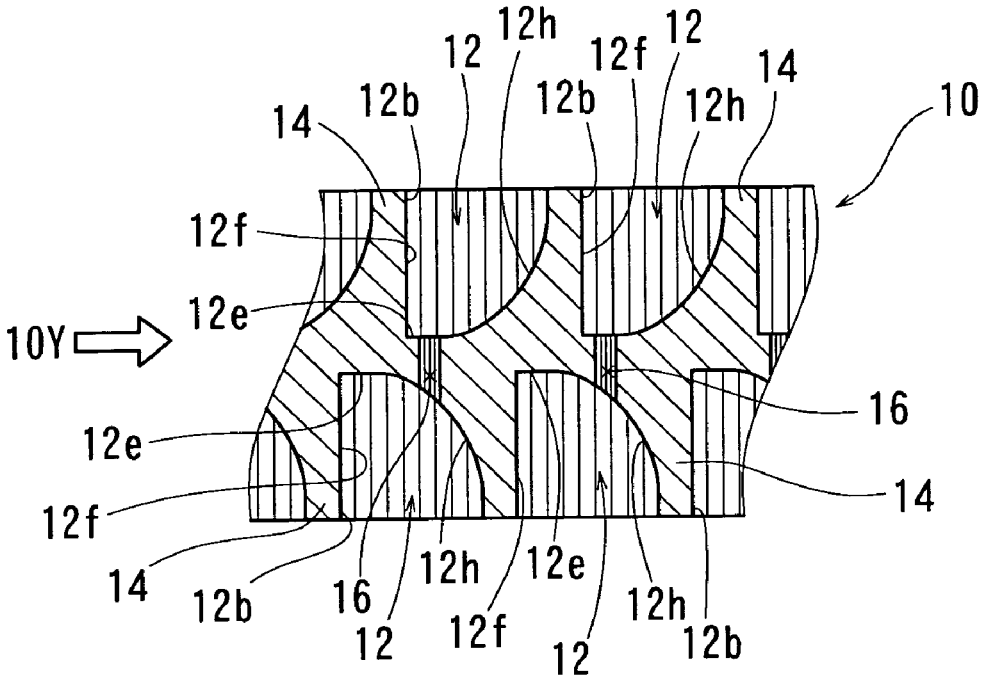
FIG. 9 is a sectional view taken along line IX—IX in FIG. 8.

Referring to FIG. 9, the grooves 12 disposed on the side of the first surface (hereinafter also called "first side grooves 12") and the grooves 12 disposed on the side of the second surface (hereinafter called "second side grooves 12") of the impeller 10 may be displaced from each other in the circumferential direction of the impeller 10 by a distance that corresponds to half the pitch of the grooves 12. The pitch of the first side grooves 12 and the pitch of the second side grooves 12 on the first may be equal to each other. The impeller 10 that has the first side grooves 12 displaced half the pitch of the second side grooves 12 will be hereinafter also called "first impeller."

Figure 10:
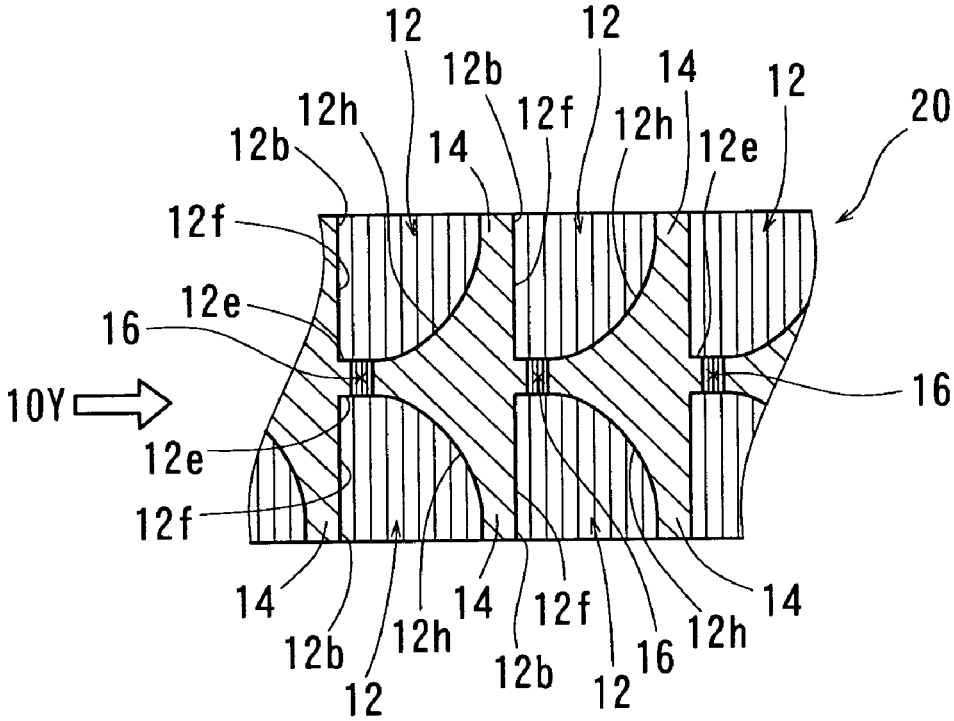
FIG. 10 is a view similar to FIG. 9 but showing a second and alternative impeller.

On the other hand, referring to FIG. 10, the first side grooves 12 and the second side grooves 12 of the impeller 10 may be disposed at the same positions in the circumferential direction. The impeller shown in FIG. 10 may be hereinafter called "second impeller" and reference numeral 20 is affixed to the impeller shown in FIG. 10 in place of the reference numeral 10. The impeller 20 may have the same construction as the impeller 10 except for the relative position of the first side groves 12 and the second side grooves 12. Therefore, the impeller 20 will not be described further.

Figure 8:
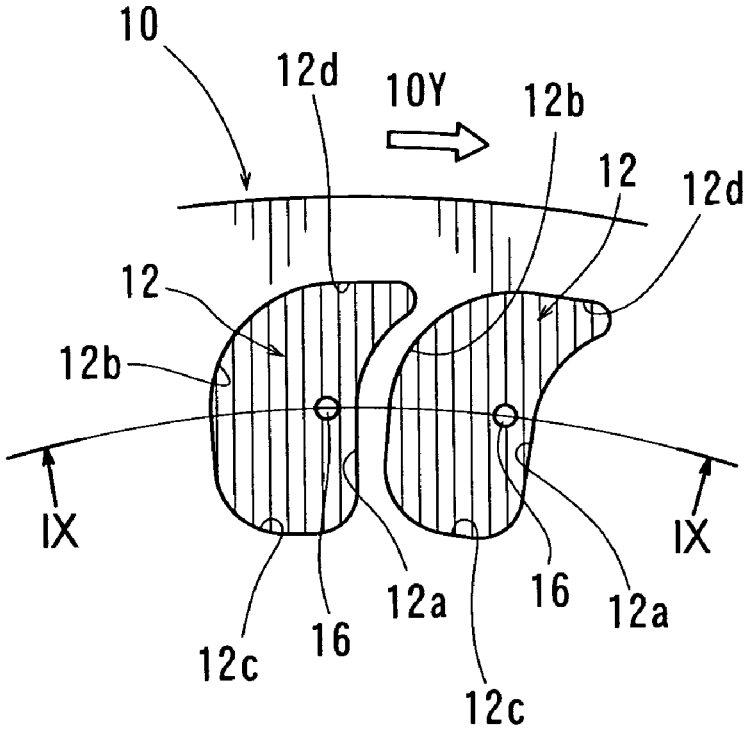
FIG. 8 is an enlarged view of a region VIII in FIG. 7.

The configuration of each grooves 12 will now be described. Referring to FIG. 8, each groove 12 defines an opening that has a substantially rectangular configuration. The opening may include a front edge 12*a*, a rear edge 12*b*, an inner edge 12*c* and an outer edge 12*d*. The front edge 12*a* may be positioned on the front side in the rotational direction of the impeller 10 as indicated by an arrow 10Y in FIG. 8. The rear edge 12*b* may be positioned on the rear side in the rotational direction of the impeller 10 (left side as viewed in FIG. 8). The inner edge 12*c* may be poisoned on the inner side in the radial direction of the impeller 10 (lower side as viewed in FIG. 8). The outer edge 12*d* may be positioned on the outer side in the radial direction of the impeller 10 (upper side as viewed in FIG. 8).

The front edge 12*a* and the rear edge 12*b* may extend substantially in the radial direction of the impeller 10 and may have outer end portions that are curved in the rotational direction of the impeller 10 (direction indicated by the arrow 10Y). The inner edge 12*c* may be smoothly connected to inner end portions in the radial direction of the front edge 12*a* and the rear edge 12*b*. The outer edge 12*d* may be smoothly connected to outer end portions in the radial direction of the front edge 12*a* and the rear edge 12*b*.

Referring to FIG. 9 or FIG. 10, the opening of each groove 12 may have a rear wall 12*f* that extends from the rear edge 12*b* to a bottom portion 12*e* of the opening. The rear wall 12*f* may define a front wall of the fin 14. The rear wall 12*f* may extend substantially perpendicular to the second surface (or the first surface) of the impeller 10. In addition, a front wall 12*h* may extend from the front edge 12*a* to the bottom portion 12*e* and may define a rear wall of the fin 14. The front wall 12*h* may have a substantially arc-shaped configuration in cross section, so that the depth of the groove 12 becomes maximum at the bottom portion 12*e* in a position adjacent to the rear wall 12*f*.

Referring again to FIG. 9, each pair of two opposing grooves 12 (one defined in the first surface and the other defined in the second surface of the impeller 10) may communicate with each other via a communication hole 16. The communication hole 16 may open on both sides of the impeller 10. More specifically, the communication hole 16 of the impeller 10 ("first impeller" in this case) may be configured to communicate between the front wall 12*h* of the groove 12 defined in the first surface (lower surface as viewed in FIG. 9) of the impeller 10 and the bottom portion 12*e* of the groove 12 defined in the second surface(upper surface as viewed in FIG. 9) of the impeller 10. Alternatively, the communication hole 16 of the first impeller 10 may be configured to communicate between the bottom portion 12*e* of the groove 12 defined in the first surface (lower surface as viewed in FIG. 9) and the front wall 12*h* of the groove 12 defined in the second surface (upper surface as viewed in FIG. 9). In this manner, the positions of the communication hole 16 may be changed in various ways.

On the other hand, as shown in FIG. 10, the communication hole 16 of the second impeller 20 may be configured to communicate between the bottom portion 12*e* of the groove 12 defined in the first surface (lower surface as viewed in FIG. 10) of the impeller 20 and the bottom portion 12*e* of the groove 12 defined in the second surface (upper surface as viewed in FIG. 10) of the impeller 20. Alternatively, the communication hole 16 of the second impeller 20 may be configured to communicate between the front wall 12*h* of the groove 12 defined in the first surface and the front wall 12*h* defined in the second surface of the impeller 20. Also, the positions of the communication hole 16 of the second impeller 20 may be changed in various ways.

Figure 3:
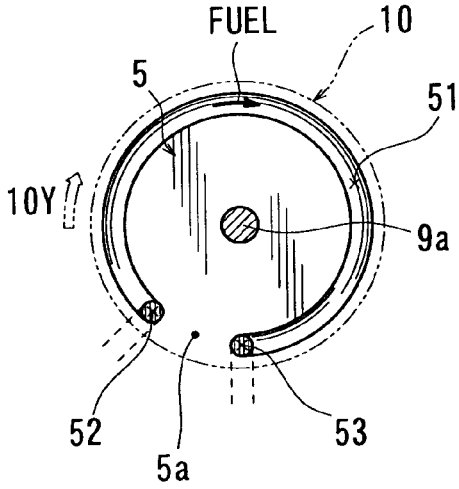
FIG. 3 is a sectional view taken along line III—III in FIG. 2.

Referring to FIG. 3, a first pump channel 51 may be formed in a wall surface of the pump cover 5, which wall surface defines a part of the impeller accommodating space and opposes to the first side grooves 12 of the impeller 10. Preferably, the first pump channel 51 may be configured as a substantially C-shaped recess. A first suction port 52 and a first discharge port 53 also may be formed in the pump cover 5 and may communicate with a start end and a terminal end of the first pump channel 51, respectively. The pump cover 5 may define a first partition wall 5*a* that serves as an interruption region of the first pump channel 51. Thus, the first suction port 52 and the first discharge port 53 may be separated from each other in the circumferential direction by the first partition wall 5*a*.

Figure 4:
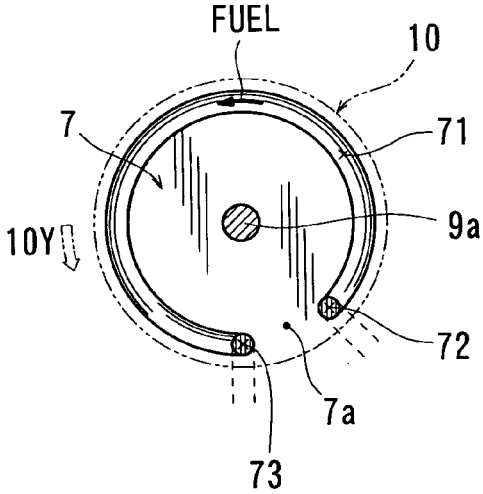
FIG. 4 is a sectional view taken along line IV—IV in FIG. 2.

Referring to FIG. 4, a second pump channel 71 may be formed in a wall surface of the pump body 7, which wall surface defines a part of the impeller accommodating space and opposes to the second side grooves 12 of the impeller 10. Preferably, the second pump channel 71 may be configured as a substantially C-shaped recess. A second suction port 72 and a second discharge port 73 also may be formed in the pump body 7 and may communicate with a start end and a terminal end of the second pump channel 71, respectively. The pump body 7 may define a second partition wall 7*a* that serves as an interruption region of the second pump channel 71. Thus, the second suction port 72 and the second discharge port 73 may be separated from each other in the circumferential direction by the second partition wall 7*a*.

Figure 5:
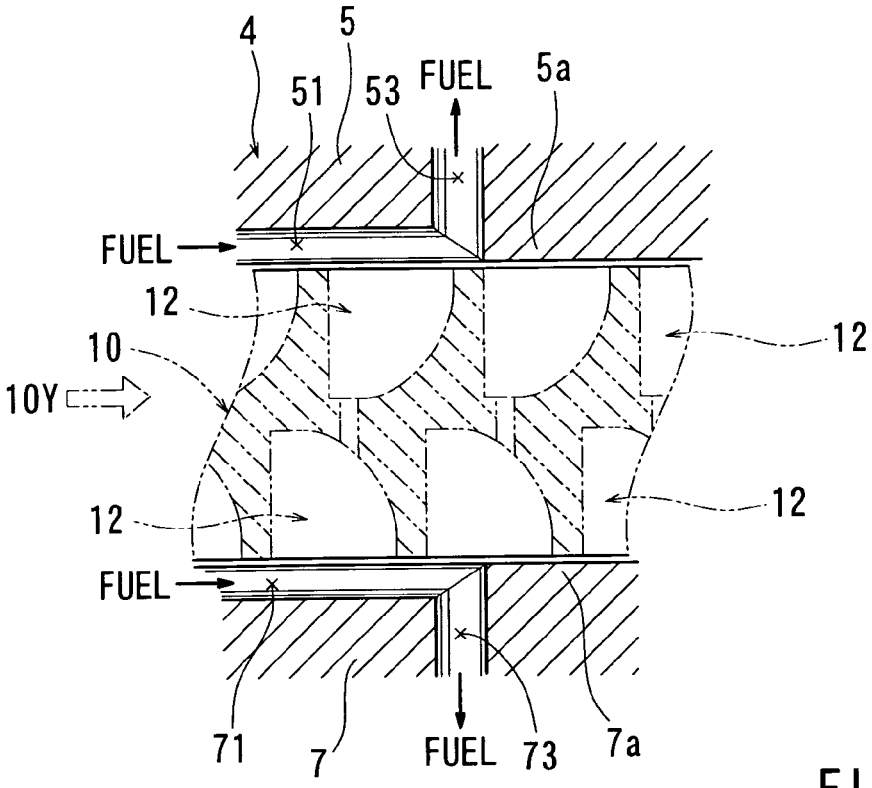
FIG. 5 is a sectional view of a first pump casing of the basic representative Westco pump.

Referring to FIG. 5, the first discharge port 53 and the second discharge port 73 may be disposed at the same position in the circumferential direction of the impeller 10. The pump casing 4 having the first discharge port 53 and the second discharge port 73 arranged in this manner may be hereinafter also called "first pump casing." The first suction port 52 and the second suction port 72 also may be disposed at the same position in the circumferential direction of the impeller 10. However, the relative position between the first suction port 52 and the second suction port 72 may not be limited to this arrangement.

Figure 6:
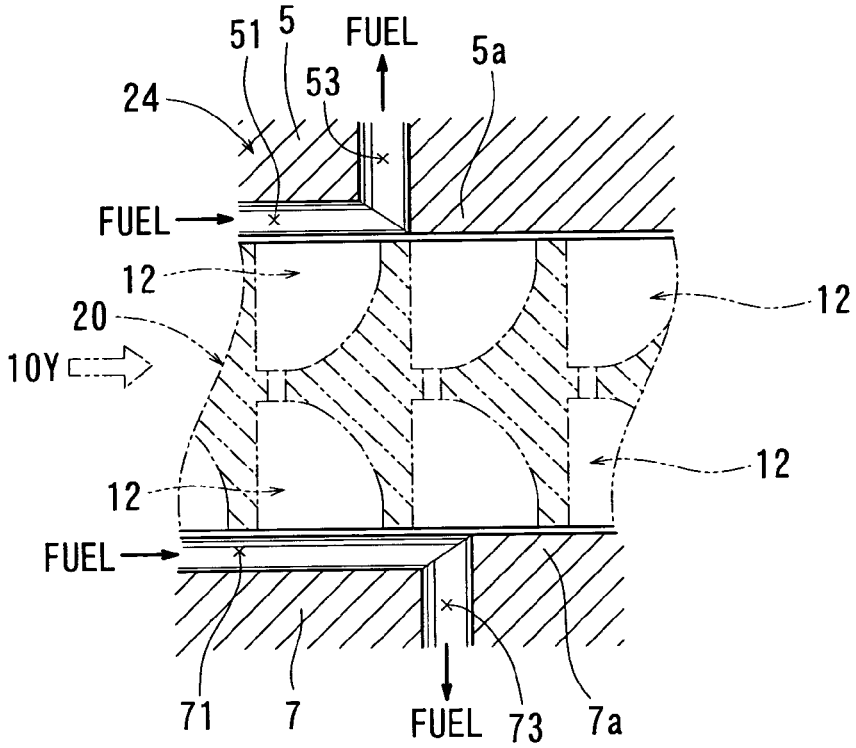
FIG. 6 is a sectional view of a second and alternative pump casing of the basic representative Westco pump.

On the other hand, referring to FIG. 6, the first discharge port 53 and the second discharge port 73 may be displaced from each other in the circumferential direction by a distance corresponding to half the pitch of the grooves 12 of the impeller 10. The pump casing 4 having the discharge port 53 and the second port 73 arranged in this manner may be hereinafter called "second pump casing" and the reference numeral 24 may be affixed to the second pump casing. The other construction of the second pump casing 24 may be the same as the first pump casing 4 and will not be described further.

Returning to FIG. 1, a fuel discharge channel 50 may be formed in the pump cover 5 and a convergence channel 62 may be formed in the spacer 6. One end (upper end as viewed in FIG. 1) of the fuel discharge channel 50 may communicate with the space 2*a* defined in the motor section 2. The other end (lower end as viewed in FIG. 1) of the fuel discharge channel 50 may communicate with the convergence channel 62. The first discharge port 53 and the second discharge port 73 may communicate with convergence channel 62, so that the flow of the fuel from the fist discharge port 53 and the flow of the fuel from the second discharge port 73 may converge at the convergence channel 62 (see FIG. 2). The fuel discharge channel 50 and the convergence channel 62 may define a convergence path through which the fuel flows after convergence.

The operation of the basic representative Westco pump will now be described. Referring to FIG. 1, in order to rotate the armature 9, an electric power (DC power) may be supplied from the power source to the armature 9 (armature coil) of the motor section 2. As the armature 9 rotates, the impeller 10 may rotate in a direction indicated by the arrow 10Y in FIG. 7. Then, the pumping actions may be performed by the impeller 10, and the fuel stored within the fuel tank (not shown) may be drawn into a distribution channel 61 via a fuel inlet 70 of the pump casing 4. Thereafter, the flow of the fuel may be diverged into the first pump channel 51 and the second pump channel 71 (see FIG. 2).

The fuel that has been supplied into the first pump channel 51 and the second pump channel 71 may receive kinetic energies from the grooves 12 (fins 14) defined on both sides of the impeller 10 and may be pressurized within the first and second pump channels 51 and 71 so as to be fed toward the first and second discharge ports 53 and 73, respectively. The fuel that has reached the terminal ends of the first and second pump channels 51 and 71 may be introduced into the convergence channel 62 via the first and second discharge ports 53 and 73. Thereafter, the fuel may enter the space 2*a* of the motor section 2 via the fuel discharge channel 50 (see FIG. 1). The fuel may further flow from the space 2*a* of the motor section 2 to the fuel delivery pipe (not shown) via the fuel outlet 8*a* of the motor cover 8. The path of the flow of the fuel is indicated by arrows in FIG. 1.

First Representative Embodiment

Figure 11:
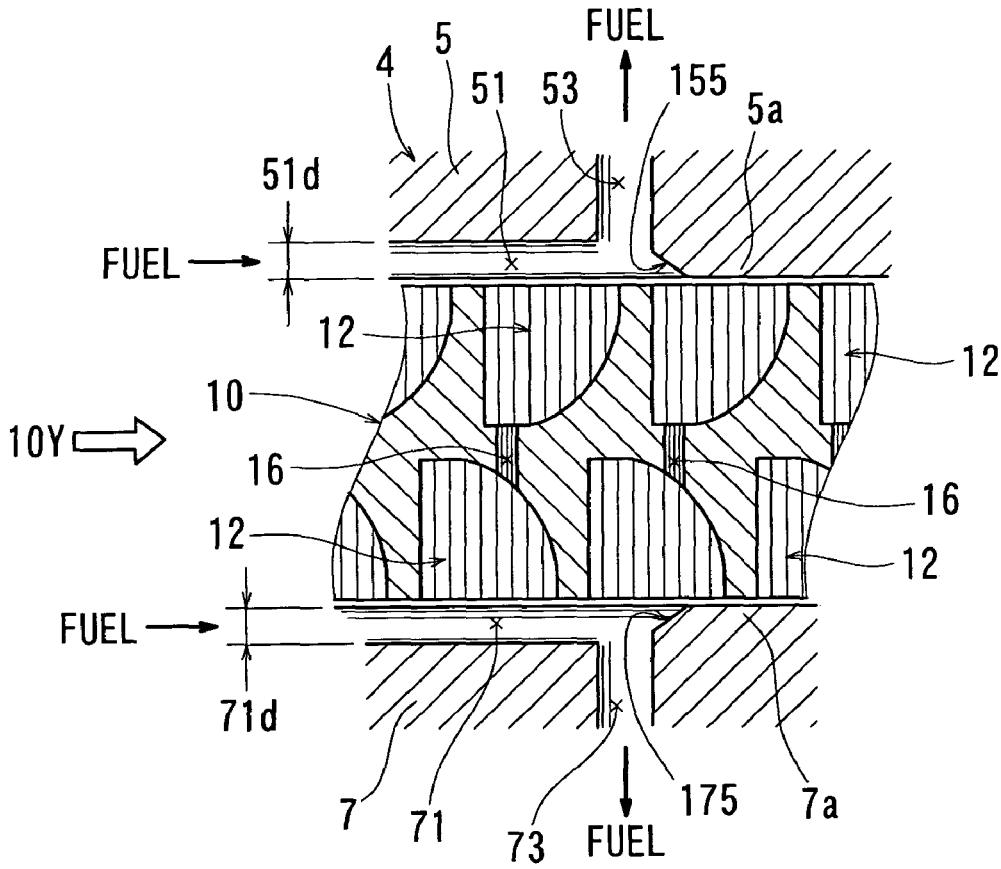
FIG. 11 is a sectional view of a part of a pump casing and an impeller of a first representative Westco pump.
Figure 12:
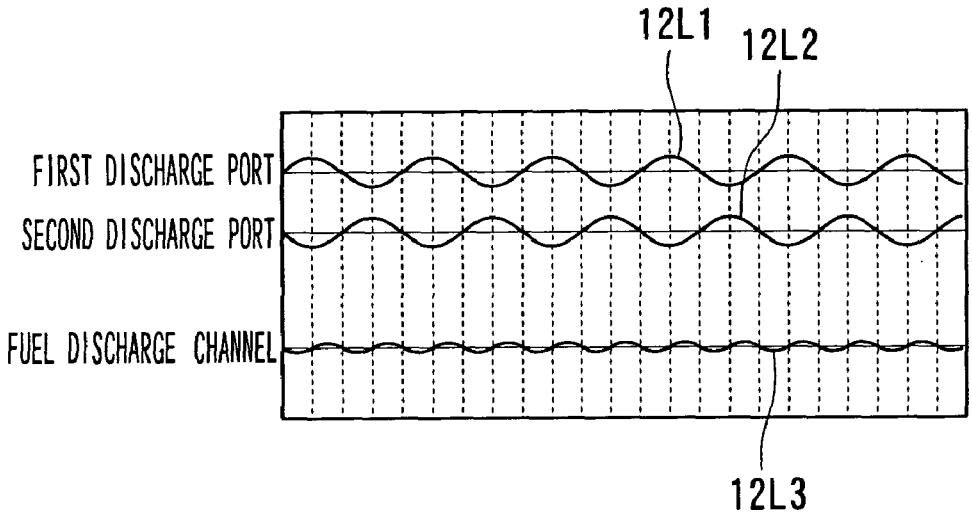
FIG. 12 is a graph showing forms of pulsations of fuel at first and second discharge ports and a convergence channel.

A first representative Westco pump will now be described with reference to FIG. 11. Referring to FIG. 11, the first representative Westco pump may include the combination of the first pump casing 4 (see FIG. 5) and the first impeller 10 (see FIG. 9) of the basic representative Westco pump. Thus, the first discharge port 53 of the first pump channel 51 and the second discharge portion 73 of the second pump channel 71 may be disposed at the same position in the circumferential direction of the impeller 10. In addition, the first side grooves 12 of the impeller are displaced from the second side grooves 12 in the circumferential direction by a distance of half the groove pitch. These arrangements may serve to cancel the pulsations of the fuel as will be hereinafter described.

Further, as shown in FIG. 11, a corner of the first partition wall 5*a* opposing to the terminal end of the first pump channel 51 on the side of the first discharge port 53 may be chamfered to define an inclined surface 155. Similarly, a corner of the second partition wall 7*a* opposing to the terminal end of the second pump channel 71 on the side of the second discharge port 73 may be chamfered to define an inclined surface 175. The inclined surfaces 155 and 175 may be symmetrical with each other with respect to the impeller 10. Therefore, at the terminal end of the fist pump channel 51 on the side of the first discharge port 53, the inclined surface 155 may define a region, where a depth 51*d* of the first flow channel 51 opposing to the second side grooves 12 of the impeller 10 gradually decreases in the rotational direction of the impeller 10. Similarly, at the terminal end of the second pump channel 71 on the side of the second discharge port 73, the inclined surface 175 may define a region, where a depth 71*d* of the second flow channel 71 opposing to the first side grooves 12 of the impeller 10 gradually decreases in the rotational direction of the impeller 10. As the directions of flows of the fluid are changed from the first and second pump channels 51 and 71 toward the first and second discharge ports 155 and 175, respectively, the fuel may collide with the partition walls 5*a* and 7*a* to apply impacts thereon. However, because of gradual decrease in depth at the inclined surfaces 155, 175, the impacts of the fuel on the partition walls 5*a* and 7*a* may be reduced. Thus, the inclined surfaces 155 and 175 may serve as an impact reducing device.

According to the first representative Westco pump, the phase of pulsation (indicated by line 12L1 in FIG. 12) of the fuel discharged from the first discharge port 53 (see FIG. 11) may be shifted by half the cyclic period of the pulsation relative to the phase of pulsation (indicated by line 12L2 in FIG. 12) of the fuel discharged from the second discharge port 73 (see FIG. 11). Because the fuel discharged from the first discharge port 53 and the fuel discharged from the second discharge port 73 converge at the convergence channel 62 (see FIG. 2), the pulsation of the fuel discharged from the first discharge port 53 and the pulsation of the fuel discharged from the second discharge port 73 may be canceled with each other as indicated by line 12L3 in FIG. 12. After the pulsations have been canceled, the fuel may be fed to the fuel discharge channel 50 (see FIG. 2). Thus, the arrangement of the first side grooves 12 and the second side grooves 12 that are displaced from each other by the distance of half the groove pitch may serve as a pulsation canceling device.

Because of the synergetic actions of the impact reduction device and the pulsation canceling device, the pump noises that may be produced by the impacts and the pulsations of the fuel can be reduced or minimized.

In addition, because each of the first side grooves 12 of the impeller 10 communicates with the corresponding second side grooves 12 opposing via the communication hole 16 (see FIG. 11), the pressure of the fuel within the first pump channel 51 and the pressure of the fuel within the second pump channel 71 may be equalized to each other. Therefore, no substantial force may be applied to the impeller 10 in the axial direction. As a result, the impeller 10 can smoothly rotate, so that the pumping efficiency can be improved.

Second Representative Embodiment

A second representative Westco pump will now be described. The second representative Westco pump is a modification of the first representative Westco pump. Therefore, the description will be made to only the features that are different from the first representative Westco pump and the same explanation will not be repeated.

Figure 13:
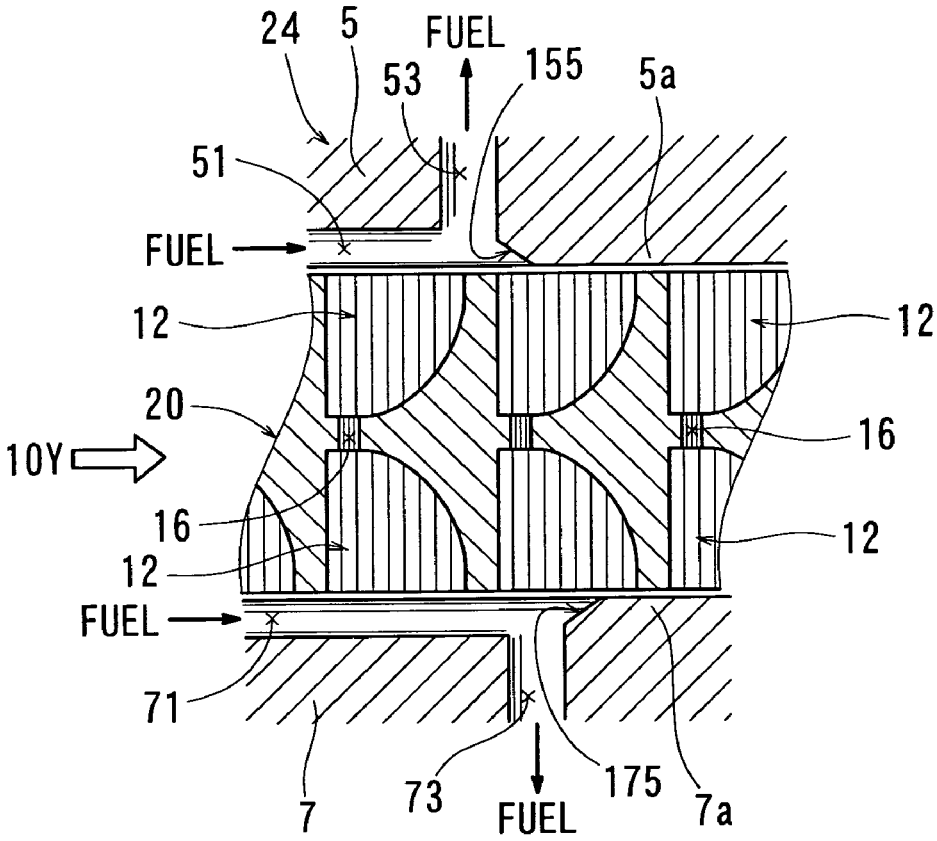
FIG. 13 is a sectional view of a part of a pump casing and an impeller of a second representative Westco pump.

Referring to FIG. 13, the second representative Westco pump may include the combination of the second pump casing 24 (see FIG. 6) and the second impeller 20 (see FIG. 10) of the basic representative Westco pump.

Thus, the first side grooves 12 and the second side grooves 12 of the impeller 20 are positioned at the same positions with each other in the circumferential direction. The first discharge port 53 of the first pump channel 51 and the second discharge port 73 of the second pump channel 71 are displaced from each other in the circumferential direction by the distance corresponding to half the groove pitch.

Further, in the same manner as the first representative embodiment, the inclined surfaces 155 and 175 serving as the impact reduction device are formed on the partition walls 5*a* and 7*a* at the terminal ends of the first pump channel 51 and the second pump channel 71 on the side of the first discharge port 55 and the second discharge port 175, respectively.

According to the second representative Westco pump, because of the arrangement of the first discharge port 53 of the first pump channel 51 and the second discharge port 73 of the second pump channel 71 that are displaced from each other in the circumferential direction by the distance corresponding to half the groove pitch, the phase of pulsation of the fuel discharged from the first discharge port 53 and the phase of pulsation of the fuel discharged from the second discharge port 73 may be shifted by half the cyclic period of the pulsation. This arrangement may serve as a pulsation canceling device. Thus, when the flow of the fuel from the first discharge port 53 and the flow of the fuel from the second discharge port 73 converge at the convergence channel 62 (see FIG. 2), the pulsations of these flows may be canceled each other.

In addition, because of the inclined surfaces 155 and 157 that serve as the impact reducing devices for the first pump channel 51 and the second pump channel 71, respectively, the impacts of the fuel due to change of directions of flow from the first and second pump channels 51 and 71 toward the first and second discharge ports 53 and 73 may be reduced or minimized.

Because of the synergetic actions of the impact reduction devices and the pulsation canceling device, the pump noises that may be produced by the impacts and the pulsations of the fuel can be minimized.

Third Representative Embodiment

A third representative Westco pump will now be described. The third representative Westco pump is a modification of the first representative Westco pump. More specifically, the third representative Westco pump is different from the first representative Westco pump only in the construction of the impact reducing devices. Therefore, the description will be made to only the impact reducing devices.

Figure 14:
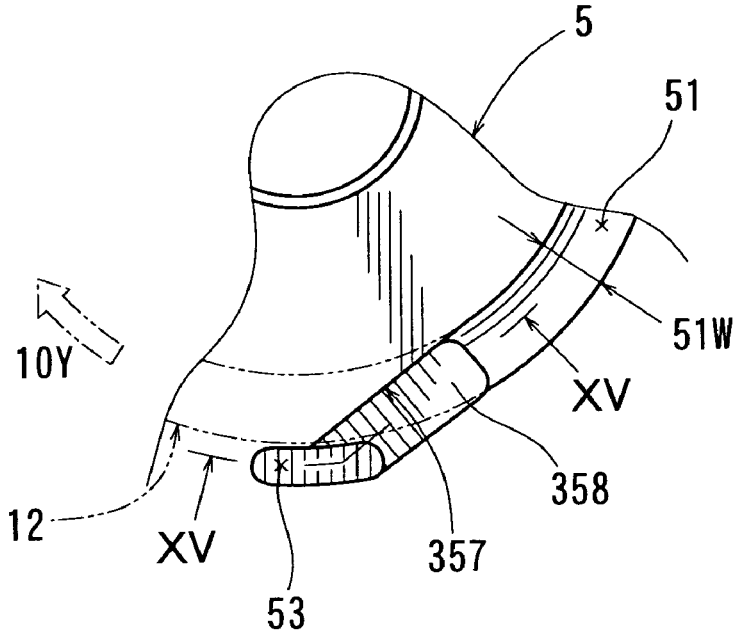
FIG. 14 is a view on the side of an impeller of a part of a pump body around a first discharge port of a third representative Westco pump.

Referring to FIG. 14, the terminal end of the first pump channel 51 on the side of the first discharge port 53 may extend outwardly and tangentially from the first pump channel 51. The first pump channel 51 may be defined in the pump cover 5. Therefore, the first discharge port 53 may be positioned radially outward of the grooves 12 of the impeller 10 (see FIG. 7). As shown in FIG. 14, the first pump channel 51 may have a width 51W that corresponds to the width of the grooves 12 of the impeller 10 in the radial direction. At the extended terminal end, the width 51W of a part of the first pump channel 51 opposing to the grooves 12 of the impeller 10 may gradually decrease in the rotational direction of the impeller 10. Thus, the extended terminal end is configured as a width decreasing region 357.

Figure 15:
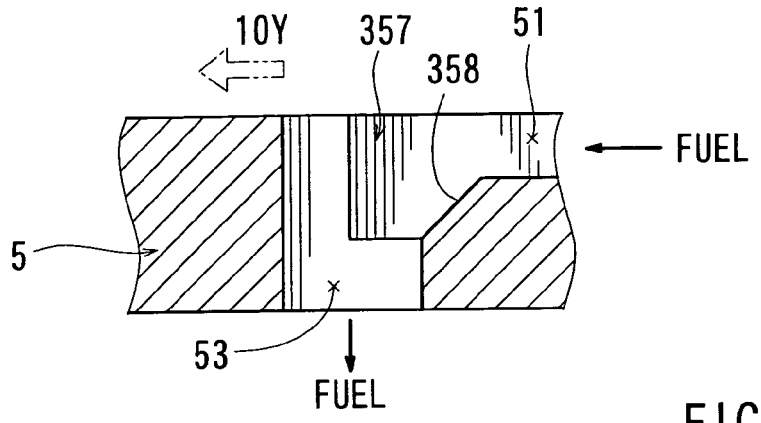
FIG. 15 is a sectional view taken along line XV—XV in FIG. 14.

In addition, as shown in FIG. 15, the pump cover 5 may define an inner corner portion at a transient point from the first pump channel 51 to the first discharge port 53. The corner portion may be chamfered to form an inclined surface 358, so that the fuel may smoothly flow from the first pump channel 51 to the first discharge port 53.

Although not shown in the drawings, the second pump channel 71 of the pump body 7 (see FIG. 4) also may have an extended terminal end similar to the first pump channel 51 shown in FIG. 14 and the pump body 7 may define the width decreasing region 357 and the inclined surface 358 at the extended terminal end.

According to the third representative Westco pump, because the part of the width of the first pump channel 51 opposing to the grooves 12 of the impeller 10 gradually decreases at the width decreasing region 357 (see FIG. 14), the impacts of the fuel that may be caused by the change of direction from the first pump channel 51 (see FIG. 3) toward the first discharge port 53 may be reduced or minimized. Similarly, the impacts of the fuel that may be caused by the change of direction from the second pump channel 71 (see FIG. 4) toward the second discharge port 73 may be reduced or minimized by the width decreasing region 357.

In order to cancel the pulsations of the fuel, the third representative Westco pump may incorporate the combination of the first pump casing 4 (see FIG. 5) and the first impeller 10 (see FIG. 9). However, this combination may be replaced with the combination of the second pump casing 24 (see FIG. 6) and the second impeller 29 (see FIG. 10).

Fourth Representative Embodiment

A fourth representative Westco pump will now be described. The fourth representative Westco pump is a modification of the first representative Westco pump. More specifically, the fourth representative Westco pump is different from the first representative Westco pump only in the construction of the impact reducing devices. Therefore, the description will be made to only the impact reducing devices.

The impact reducing devices of the fourth representative Westco pump may be similar to impact reducing means disclosed in Japanese Laid-Open Publication No. 2000-329085.

Figure 16:
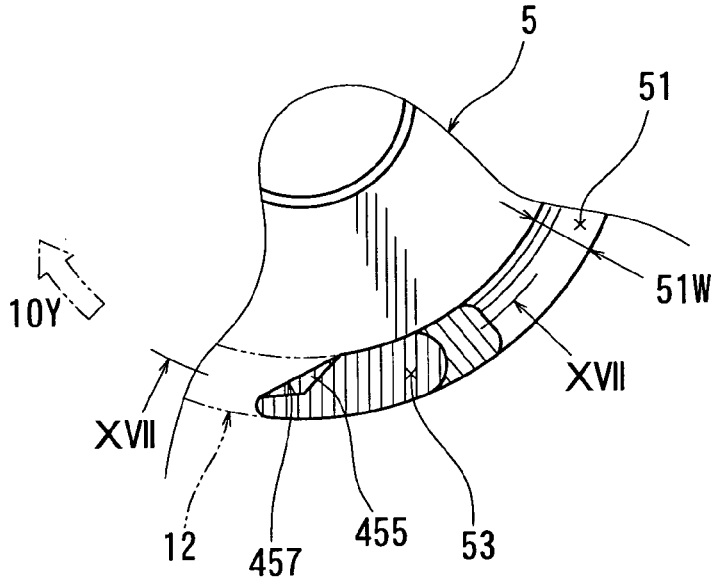
FIG. 16 is a view on the side of an impeller of a part of a pump body around a first discharge port of a fourth representative Westco pump.

Thus, the first discharge port 53 of the first pump channel 51 defined in the pump cover 5 may be elongated in the circumferential direction of the impeller 10 as shown in FIG. 16. In addition, the terminal end of the first pump channel 51 on the side of the first discharge port 53 may have a width decreasing region 457. Thus, a part of the width 51W of the first pump channel 51 opposing to the grooves 12 of the impeller 10 may gradually decrease at the width decreasing region 457 in the rotational direction of the impeller 10.

Figure 17:
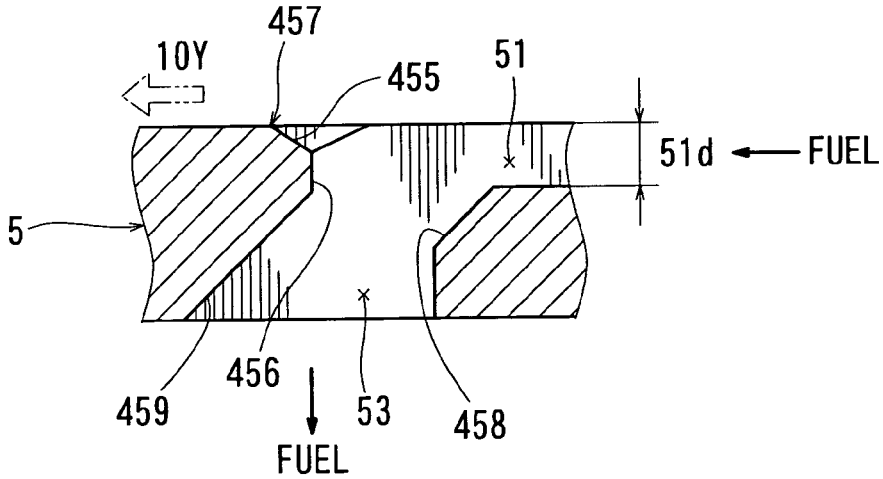
FIG. 17 is a sectional view taken along line XVII—XVII in FIG. 16.

In addition, as shown in FIG. 17, a corner portion defined by the pump cover 5 at a position opposing to the terminal end of the first pump channel 51 may be chamfered to form an inclined surface 455. The edge of the inclined surface 455 in the rotational direction of the impeller 10 may define a part of the peripheral edge of the width decreasing region 457. The inclined surface 455 may define a depth decreasing region, in which a depth 51*d* of first pump channel 51 at the terminal end may gradually decrease in the rotational direction of the impeller 10 within the region of the length of the inclined surface 455 in the circumferential direction.

Further, a corner portion defined by the pump cover 5 at the transient point from the first pump channel 51 to the first discharge port 53 may be chamfered to form an inclined surface 458, so that the fuel can smoothly from the first pump channel 51 to the first discharge port 53.

Furthermore, a front wall of the first discharge port 53 in the rotational direction of the impeller 10 may be configured as an inclined surface 459. Furthermore, a corner portion between the inclined surface 459 and the inclined surface 455 also may be chamfered to define an end surface 456.

Although not shown in the drawings, the width decreasing region 457, the inclined surfaces 455, 458 and 459 and the end surface 456 also may be defined by the pump body 7 (see FIG. 4) at the terminal end of the second pump channel 71 and the second discharge port 73.

According to the fourth representative Westco pump, both of the depth decreasing region 455 and the width decreasing region 457 may serve as impact reducing devices for reducing impacts of the fuel when the direction of flow of the fuel is changed from the first pump channel 51 toward the first discharge port 53. In addition, due to synergistic actions of the depth decreasing region and the width decreasing region 457, the impacts may be further reduced.

Also, in order to cancel the pulsations of the fuel, the fourth representative Westco pump may incorporate the combination of the first pump casing 4 (see FIG. 5) and the first impeller 10 (see FIG. 9). However, this combination may be replaced with the combination of the second pump casing 24 (see FIG. 6) and the second impeller 29 (see FIG. 10).

Figure 18:
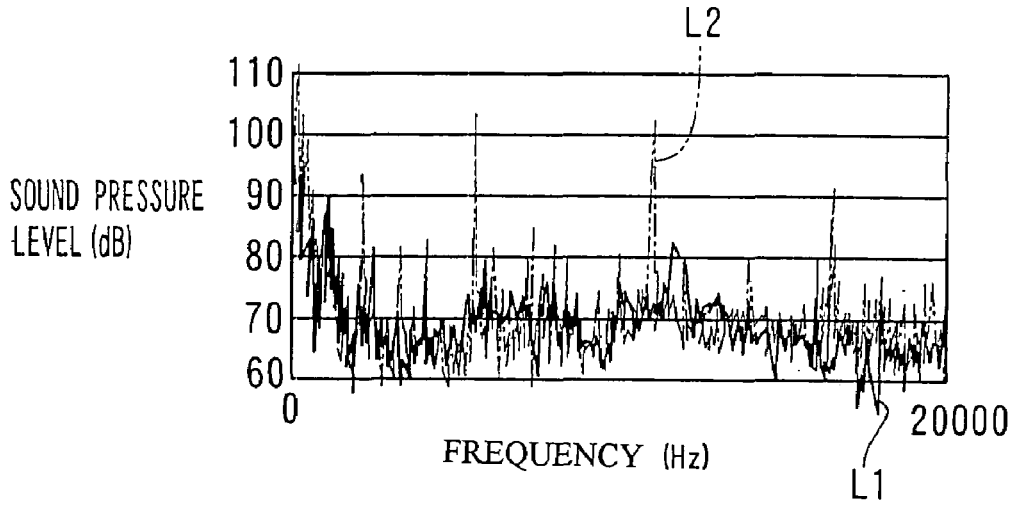
FIG. 18 is a graph showing the relation between a frequency and a sound pressure measured for the fourth representative Westco pump and a known Westco pump.

Comparative experiments have been made for the fourth representative Westco pump and the conventional Westco pump with regard to a sound pressure. FIG. 18 is a graph showing the results of the comparative experiments. In FIG. 18, an abscissa axis represents a frequency (Hz) and an ordinate axis represents a sound pressure (dB). The result of measurement for the fourth representative Westco pump is indicated by solid lines L1 and the result of measurement for the conventional Westco pump is indicated by chain lines L2. As will be seen from FIG. 8, the sound pressure level measured for the fourth representative Westco pump is lower than the sound pressure level measured for the conventional Westco pump. Therefore, the fourth representative Westco pump may produce low noises in comparison with the conventional Westco pump.

Fifth Representative Embodiment

A fifth representative Westco pump will now be described. The fifth representative Westco pump is a modification of the fourth representative Westco pump. More specifically, the fifth representative Westco pump is different from the fourth representative Westco pump only in the construction of the impact reducing devices. Therefore, the description will be made to only the impact reducing devices.

Figure 19:
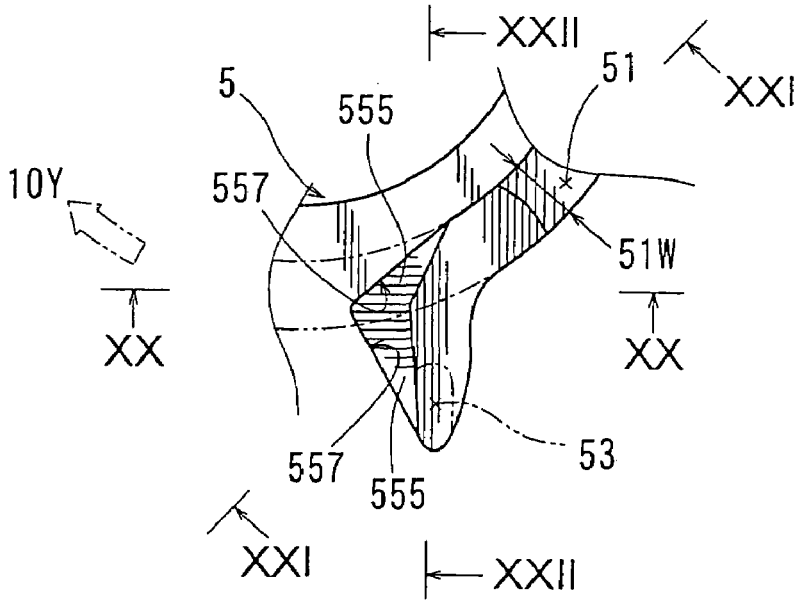
FIG. 19 is a view on the side of an impeller of a part of a pump body around a first discharge port of a fifth representative Westco pump.
Figure 20:
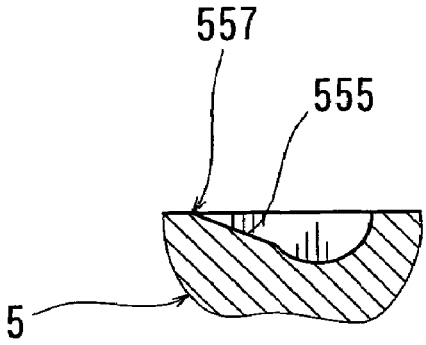
FIG. 20 is a sectional view taken along line XX—XX in FIG. 19.
Figure 21:
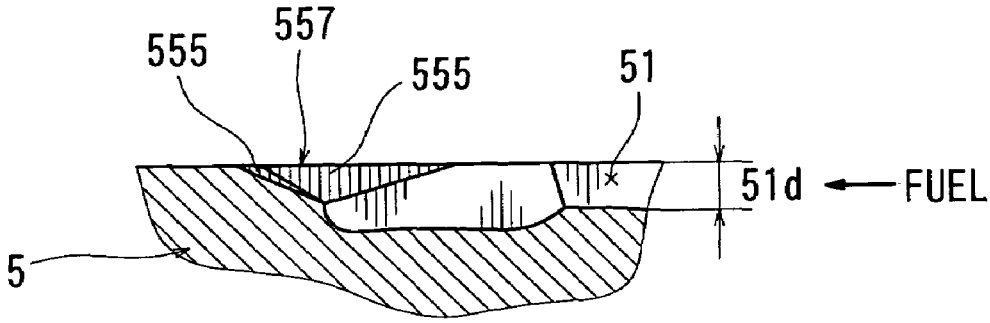
FIG. 21 is a sectional view taken along line XXI—XXI in FIG. 19.
Figure 22:
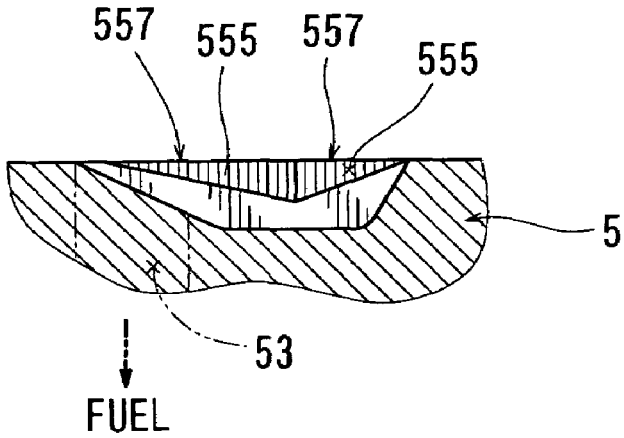
FIG. 22 is a sectional view taken along line XXII—XXII in FIG. 19.
Figure 23:
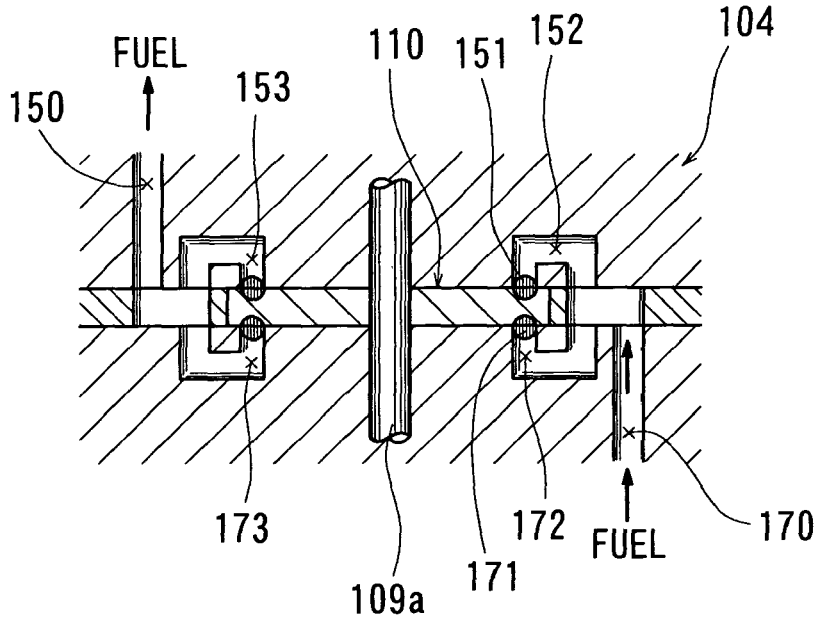
FIG. 23 PRIOR ART
FIG. 23 is a sectional view of a pump section of a known Westco pump.
Figure 24:
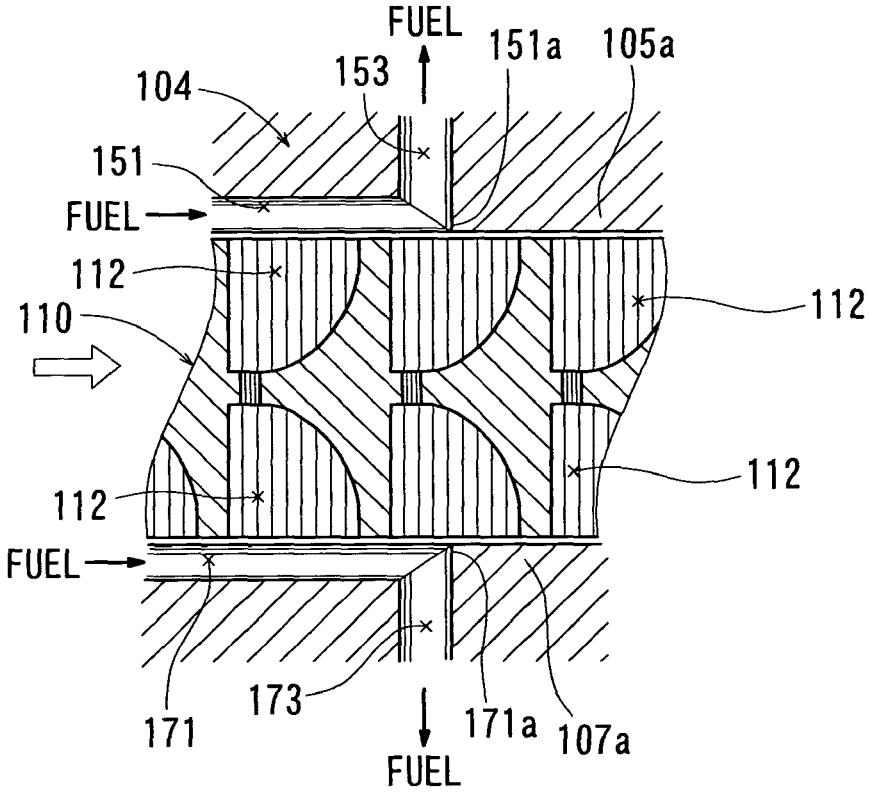
FIG. 24 PRIOR ART
FIG. 24 is an enlarged view of a part of the pump section shown in FIG. 23.

Referring to FIG. 19, the terminal end (on the side of the first discharge port 53) of the first pump channel 51 defined by the pump cover 5 may extend outwardly and tangentially from the first pump channel 51. The terminal end is then bent further outwardly in the radial direction, so that a width decreasing region 557 having a substantially L-shaped configuration may be defined at the terminal end. The first discharge port 53 may be positioned radially outside of the grooves 12 (see FIG. 7) of the impeller 10. With this arrangement, at the width decreasing region 557, a part of the width 51W of the first pump channel 51 opposing to the grooves 12 of the impeller 10 may gradually decrease in the rotational direction of the impeller 10. The position of the first discharge port 53 may be changed in response to the configuration of the width decreasing region 557.

Within the width decrease region 557, inclined surface 555 may be defined at the terminal end on the side of the first discharge port 53 of the fist pump channel 51. The inclined surfaces 555 may jointly form a substantially L-shaped configuration as viewed in FIG. 19. In addition, as will be seen from FIGS. 20 to 22, the inclined surfaces 555 may have a substantially V-shaped cross section. Further, the inclined surfaces 555 may have edges that are joined to the peripheral edge of the width decreasing region 557. At the terminal end of the first pump channel 51, the inclined surfaces 555, in particular, one of the inclined surfaces 555 disposed on the upper side as viewed in FIG. 19, may serve to gradually reduce the depth 51*d* (see FIG. 21) of a part of the first pump channel 51 that opposes to the grooves 12 of the impeller 10. More specifically, the depth 51*d* may decrease in the rotational direction of the impeller 10 at this part. Thus, the inclined surfaces 555 may define a depth decreasing region.

Although not shown in the drawings, the width decreasing region 557 and the inclined surfaces 555 also may be defined by the pump body 7 (see FIG. 4) at the terminal end of the second pump channel 71 on the side of the second discharge port 73.

According to the fifth representative Westco pump, both of the width decreasing region 557 and the depth decreasing region defined by the inclined surfaces 555 may serve as impact reducing devices for reducing impacts of the fuel when the direction of flow of the fuel is changed from the first pump channel 51 toward the first discharge port 53. In addition, because of the synergistic actions of the width decreasing region 557 and the depth decreasing region, the impacts may be further reduced.

Also, in order to cancel the pulsations of the fuel, the fifth representative Westco pump may incorporate the combination of the first pump casing 4 (see FIG. 5) and the first impeller 10 (see FIG. 9). However, this combination may be replaced with the combination of the second pump casing 24 (see FIG. 6) and the second impeller 29 (see FIG. 10).

Although the representative embodiments have been described in connection with Westco pumps that are used as fuel pumps for automobiles, the present invention may be applied to pumps for pumping any other kind of fluid, e.g., hydraulic fluid and water.

In addition, the position of the communication hole 16 communicating between each opposing pair of the grooves 12 of the impeller 10 (20) may be suitably determined. Further, a plural number of the communication holes may be provided for communicating between each opposing pair of the grooves 12.

The invention claimed is:

1. An impeller pump for a fluid, comprising:

a rotary impeller having a first surface and a second surface opposing to each other, each of the first and second surfaces including a plurality of grooves arranged in a circumferential direction of the impeller and spaced from each other by a predetermined pitch;

a pump casing defining a first pump channel and a second pump channel, wherein the rotary impeller is disposed within the pump casing and opposes to the first pump channel and the second pump channel, respectively;

a convergence device arranged and constructed to converge the fluid discharged from the first pump channel and the fluid discharged from the second pump channel;

a pulsation canceling device arranged and constructed to cancel pulsations of the fluid discharged from the first pump channel and the second pump channel, respectively; and an impact reducing device arranged and constructed to reduce impacts produced by at least one of the flow of the fluid from the first pump channel and the flow of the fluid from the second pump channel;

wherein the pump casing further defines a first discharge port and a second discharge port respectively communicating with the first pump channel and the second pump channel and formed separately from each other, so that the fluid is discharged from the first and second channels via the respective first and second discharge ports and is converged at the convergence device; and wherein the pulsation canceling device is arranged and constructed to displace the first discharge port from the second discharge port by a distance corresponding to half the predetermined pitch of the grooves of the impeller, and the grooves of the impeller defined in the first surface and the grooves of the impeller disposed in the second surface are disposed at the same positions in the circumferential direction of the impeller.

2. An impeller pump as in claim 1, wherein:

the pump casing further defines a first suction port and a second suction port;

the first pump channel opposes to the grooves of the first surface of the impeller, the first pump channel communicates with the first suction port and the first discharge port, and the first suction port and the first discharge port are separated from each other by a first partition wall;

the second pump channel opposes to the grooves of the second surface of the impeller, the second pump channel communicates with the second suction port and the second discharge port, and the second suction port and the second discharge port are separated from each other by a second partition wall;

the convergence device comprises a convergence channel communicating with the first discharge port and the second discharge port, so that the fluid discharged from the first discharge port and the fluid discharged from the second discharge port converge at the convergence channel;

the pulsation canceling device is arranged and constructed to cancel pulsations of the fluid discharged from the first discharge port and the second discharge port, respectively; and the impact reducing device is arranged and constructed to reduce impacts of the fluid caused by change of direction of at least one of a flow of the fluid discharged from the first pump channel toward the first discharge port and a flow of the fluid discharged from the second pump channel toward the second discharge port.

3. An impeller pump as in claim 2, wherein the pulsation canceling device is arranged and constructed to shift a phase of the pulsation of the fluid discharged from the first discharge port from a phase of the pulsation of the flow of the fluid discharged from the second discharge port.

4. An impeller pump as in claim 2, wherein the first pump channel and the second pump channel include terminal ends that communicate with the first discharge port and the second discharge port, respectively, and each of the terminal ends has at least a part opposing to the grooves defined in the corresponding one of the first and second surfaces of the impeller, and the impact reducing device is arranged and constructed to gradually reduce a sectional area of the part of the terminal end in the rotational direction of the impeller.

5. An impeller pump as in claim 4, wherein each of the first and second pump channels has a width in a radial direction of the impeller, the impact reducing device comprises a width decreasing region defined by at least one of the terminal ends of the first and second pump channels, and the width decreasing region is configured to gradually reduce the width of the part of at least one of the terminal ends in the rotational direction.

6. An impeller pump as in claim 5, wherein the width decreasing region extends along the rotational direction of the impeller.

7. An impeller pump as in claim 5, wherein the width decreasing region extends outwardly from at least one of the first and second pump channels in a radial direction of the impeller.

8. An impeller pump as in claim 4, wherein each of the first and second pump channels has a depth in an axial direction of the impeller, the impact reducing device comprises a depth decreasing region disposed in at least one of the terminal ends of the first and second pump channels, and the depth decreasing region is configured to gradually reduce the depth of the part of at least one of the terminal ends in the rotational direction.

9. An impeller pump as in claim 8, wherein the depth decreasing region comprises an inclined surface opposing to the grooves defined in the corresponding one of the first and second surfaces of the impeller, wherein the inclined surface is inclined in the rotational direction of the impeller.

10. An impeller pump as in claim 2, further including at least one communication hole defined in the impeller, the communication hole communicating between a pair of the grooves that are defined in the first surface and the second surface, respectively, and opposing to each other in an axial direction of the impeller.

11. An impeller pump as in claim 1, further including a motor section that is arranged and constructed to rotate the impeller.

12. An impeller pump comprising:

a rotary impeller having a first surface and a second surface opposing to each other, wherein each of the first and second surface includes a plurality of grooves arranged in a circumferential direction of the impeller and spaced from each other by a predetermined pitch;

a pump casing;

a first pump channel defined in the pump casing and opposing to the grooves of the first surface of the impeller, wherein the first pump channel communicates with a first suction port and a first discharge port, and the first suction port and the first discharge port are separated from each other by a first partition wall;

a second pump channel defined in the pump casing and opposing to the grooves of the second surface of the impeller, wherein the second pump channel communicates with a second suction port and a second discharge port, and the second suction port and the second discharge port are separated from each other by a second partition wall;

a convergence channel communicating with the first discharge port and the second discharge port, so that the fluid discharged from the first discharge port and the fluid discharged from the second discharge port converge at the convergence channel;

a pulsation canceling device arranged and constructed to cancel pulsations of the fluid discharged from the first discharge port and the second discharge port, respectively;

an impact reducing device arranged and constructed to reduce impacts of the fluid caused by change of direction of at least one of a flow of the fluid discharged from the first pump channel toward the first discharge port and a flow of the fluid discharged from the second pump channel toward the second discharge port; and at least one communication hole defined in the impeller, the communication hole communicating between a pair of the grooves that are defined in the first surface and the second surface, respectively, and oppose to each other in an axial direction of the impeller;

wherein the first discharge port and the second discharge port are formed separately from each other in the pump casing; and wherein the pulsation canceling device is arranged and constructed to displace the first discharge port from the second discharge port by a distance corresponding to half the predetermined pitch of the grooves of the impeller, and the grooves of the impeller defined in the first surface and the grooves of the impeller disposed in the second surface are disposed at the same positions in the circumferential direction of the impeller.

13. An impeller pump as in claim 12, wherein:

the pulsation canceling device is arranged and constructed to shift a phase of the pulsation of the fluid discharged from the first discharge port from a phase of the pulsation of the flow of the fluid discharged from the second discharge port, and the first pump channel and the second pump channel include terminal ends communicating with the first discharge port and the second discharge port, respectively, and each of the terminal ends has at least a part opposing to the grooves defined in the corresponding one of the first and second surfaces of the impeller, and the impact reducing device is arranged and constructed to gradually reduce a sectional area of the part of the terminal end in the rotational direction of the impeller.

14. An impeller pump as in claim 13, wherein each of the first and second pump channels has a width in a radial direction of the impeller, the impact reducing device comprises a width decreasing region defined by at least one of the terminal ends of the first and second pump channels, and the width decreasing region is configured to gradually reduce the width of the part of at least one of the terminal ends in the rotational direction.

15. An impeller pump as in claim 14, wherein the width decreasing region extends along the rotational direction of the impeller.

16. An impeller pump as in claim 14, wherein the width decreasing region extends outward from at least one of the first and second pump channels in a radial direction of the impeller.

17. An impeller pump as in claim 13, wherein each of the first and second pump channels has a depth in an axial direction of the impeller, the impact reducing device comprises a depth decreasing region disposed in at least one of the terminal ends of the first and second pump channels, and the depth decreasing region is configured to gradually reduce the depth of the part of at least one of the terminal ends in the rotational direction.

18. An impeller pump as in claim 17, wherein the depth decreasing region comprises an inclined surface opposing to the grooves defined in the corresponding one of the first and second surfaces of the impeller, and the inclined surface is inclined in the rotational direction of the impeller.

* * * * *